US008410991B2

(12) United States Patent
Kwak et al.

(10) Patent No.: US 8,410,991 B2
(45) Date of Patent: Apr. 2, 2013

(54) ANTENNA SYSTEM FOR MOBILE VEHICLES

(75) Inventors: Chang Soo Kwak, Daejeon (KR); In Bok Yom, Daejeon (KR); Ho Jin Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 258 days.

(21) Appl. No.: 12/746,451

(22) PCT Filed: Aug. 21, 2008

(86) PCT No.: PCT/KR2008/004887

§ 371 (c)(1),
(2), (4) Date: Jun. 4, 2010

(87) PCT Pub. No.: WO2009/072732

PCT Pub. Date: Jun. 11, 2009

(65) Prior Publication Data

US 2010/0259443 A1 Oct. 14, 2010

(30) Foreign Application Priority Data

Dec. 7, 2007 (KR) ..... 10-2007-0126734

(51) Int. Cl.
*H01Q 1/42* (2006.01)

(52) U.S. Cl. ..... 343/872

(58) Field of Classification Search ..... 343/757, 343/760, 359, 875, 702, 872
See application file for complete search history.

(56) References Cited

U.S. PATENT DOCUMENTS

| | | | | |
|---|---|---|---|---|
| 5,227,806 | A | 7/1993 | Eguchi | |
| 5,794,138 | A * | 8/1998 | Briskman | 455/344 |
| 6,204,823 | B1 * | 3/2001 | Spano et al. | 343/766 |
| 6,577,281 | B2 | 6/2003 | Yamamoto et al. | |
| 6,653,985 | B2 * | 11/2003 | Sikina et al. | 343/853 |
| 7,911,400 | B2 * | 3/2011 | Kaplan et al. | 343/713 |
| 2005/0093743 | A1 | 5/2005 | Park et al. | |
| 2007/0103366 | A1 | 5/2007 | Park | |
| 2008/0291102 | A1 * | 11/2008 | Yun et al. | 343/761 |
| 2008/0298298 | A1 | 12/2008 | Eom et al. | |
| 2009/0224988 | A1 * | 9/2009 | Park | 343/703 |
| 2010/0188304 | A1 * | 7/2010 | Clymer et al. | 343/753 |
| 2010/0259443 | A1 * | 10/2010 | Kwak et al. | 342/352 |
| 2010/0283696 | A1 * | 11/2010 | Park | 343/760 |

FOREIGN PATENT DOCUMENTS

| | | | |
|---|---|---|---|
| JP | 61-129903 | A | 6/1986 |
| KR | 2001-0025591 | A | 4/2001 |
| KR | 2003-0022184 | A | 3/2003 |
| KR | 10-0405830 | B1 | 11/2003 |
| KR | 2007-0057615 | A | 6/2007 |

* cited by examiner

*Primary Examiner* — Huedung Mancuso
(74) *Attorney, Agent, or Firm* — Rabin & Berdo, P.C.

(57) ABSTRACT

The present invention relates to an antenna system mounted on a mobile vehicle. In the present invention, a power distributor and a part of a high-frequency module that includes a frequency converter are placed in an external fixed unit that is placed outside a radome. In addition, an active cooler/cooling fin, a heater, and an air circulation fan are placed at an internal bottom plane of the antenna system, and a cooling fin and cooling fan are placed at an external bottom plane of the antenna system.

10 Claims, 2 Drawing Sheets

ANTENNA SYSTEM FOR MOBILE VEHICLES

TECHNICAL FIELD

The present invention relates to an antenna system. Particularly, it relates to a satellite tracking antenna system mounted on a mobile vehicle.

The present invention was supported by the IT R&D program of MIC/IITA [2006-S-020-02, Development of Satellite and Terrestrial Convergence Technology for Internet Service on High-speed Mobile Vehicles].

BACKGROUND ART

In general, a satellite tracking antenna mounted on a mobile vehicle includes a rotation part for tracking a satellite and a fixed part to be mounted on a mobile vehicle. Most of constituent elements of the antenna system are placed in the rotation part, excluding a triplexer that is placed in the fixed part. Consequently, the weight and moment of inertia of the rotation part increase and the size of a motor is increased for high speed tracking of the satellite, and accordingly, the antenna system consumes more power.

The satellite tracking antenna system mounted on the mobile vehicle is generally placed outside, and therefore the inside of a radome should be disconnected with the outside. That is, exchange of air and moisture between the inside of the radome and the outside should be prevented. Therefore, when outdoor temperature is high, heat generated from internal parts of the radome cannot be transmitted to the outside quickly enough so the internal temperature of the radome becomes higher than the outdoor temperature, thereby causing damage to the performance and life span of the antenna. When the outdoor temperature is low, in spite of disconnection between the inside of the radome and the outside of the radome, heat generated by internal modules may not be enough to raise internal temperature to the operating range if the vehicle moves so fast that the boundary layer of the air on the outer surface of the radome gets very thin. Therefore, a method for efficiently maintaining internal temperature of the radome is desired.

The above information disclosed in this Background section is only for enhancement of understanding of the background of the invention and therefore it may contain information that does not form the prior art that is already known in this country to a person of ordinary skill in the art.

DISCLOSURE OF INVENTION

Technical Problem

The present invention has been made in an effort to provide an antenna system having advantages of consuming less power and efficiently controlling internal temperature of a radome.

Technical Solution

An exemplary antenna system mounted on a mobile vehicle according to an embodiment of the present invention includes a rotation unit and an external fixed unit.

The rotation unit transmits/receives a radio signal for satellite communication and tracks a satellite direction. The external fixed unit is placed outside a radome, and includes a frequency converter and a power distributor. The frequency converter performs frequency conversion of the radio signal for satellite communication. The power distributor supplies power to each constituent element of the antenna system.

Advantageous Effects

According to the present invention, modules are partially placed in the external fixed unit so that the rotation unit can be reduced in size and volume and capacity of an azimuth tracking motor that is used for controlling an azimuth of the rotation unit can be reduced, thereby reducing power consumption of the antenna system and weight of the motor itself.

In addition, the rotation unit of the antenna system is reduced in weight and volume so that it can be operated more promptly, thereby improving satellite tracking performance, and internal heat generation of the radome is significantly reduced by placing the frequency converter and the power distributor that generate a large amount of heat outside the radome, thereby reducing power consumed for controlling internal temperature of the radome.

In addition, a temperature controller placed inside the radome can maintain the internal temperature of the radome within a predetermined range, thereby increasing life spans of modules and elements of the radome and preventing underperformance.

MODE FOR THE INVENTION

Figure 1:
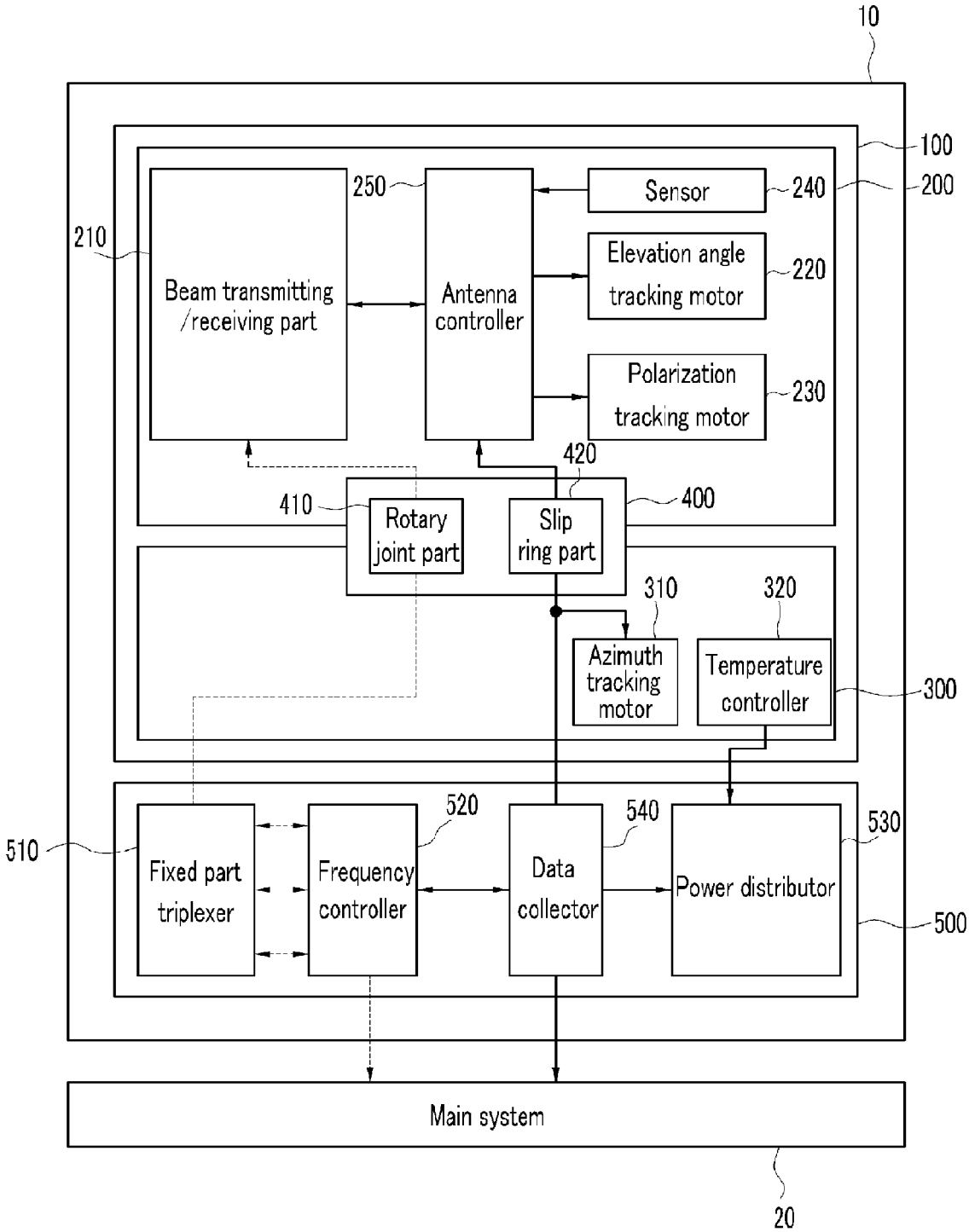
FIG. 1 is a configuration diagram of an antenna system mounted on a mobile vehicle according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims which follow, unless explicitly described to the contrary, the word "comprising" and variations such as "comprises" will be understood to imply the inclusion of stated elements but not the exclusion of any other elements. Also, the terms of a unit, a device, and a module in the present specification represent a unit for processing a predetermined function or operation, which can be realized by hardware, software, or a combination of hardware and software.

An antenna system mounted on a mobile vehicle according to an exemplary embodiment of the present invention will now be described in further detail with reference to the drawings.

In the exemplary embodiment of the present invention, a quad-band satellite tracking antenna system capable of transmitting/receiving Ka-band and Ku-band signals will be exemplarily described.

FIG. 1 shows a configuration diagram of an antenna system 10 mounted on a mobile vehicle according to the exemplary embodiment of the present invention.

As shown in FIG. 1, the antenna system 10 includes a radome 100, a rotation unit 200, an internal fixed unit 300, a connection part 400, and an external fixed unit 500 that is connected with the radome 100. The rotation unit 200, the internal fixed unit 300, and the connection part 400 are placed inside the radome 100, and the external fixed unit 500 is placed outside the radome 100.

The rotation unit 200 tracks a satellite direction, and includes a beam transmitting/receiving part 210, an elevation angle tracking motor 220, a polarization angle tracking motor 230, a sensor 240, and an antenna controller 250.

The beam transmitting/receiving part 210 includes an emission module, a reflecting plate, a Ka-band and Ku-band power amplifier, a filter, a low noise amplifier (LNA), and a Ka-band frequency up-converter, and it transmits/receives a radio signal beam for satellite communication at Ka-band and Ku-band.

The elevation angle tracking motor 220 and the polarization angle tracking motor 230 serve as a driving unit that drives the rotation unit 200 so as to direct the antenna system 10 to be satellite-oriented without regarding movement of the mobile vehicle, and drives the rotation unit 200 to track a polarization plane in the case that the beam is linearly polarized.

The sensor 240 estimates antenna attitude information that includes antenna inclination, azimuth variation, and antenna coordinates, measures temperature at each internal component of the radome 100, and transmits results of the estimation and measurement to the antenna controller 250.

The antenna controller 250 receives the antenna attitude information and temperature information from the sensor 240, and receives a satellite tracking signal from the beam transmitting/receiving part 210. In addition, the antenna controller 250 controls the elevation angle tracking motor 220, the polarization angle tracking motor 230, and an azimuth tracking motor 310 in the internal fixed unit 300 as to track the satellite based on the received information. Further, the antenna controller 250 outputs a control signal to control the external fixed unit 500 and a power distributor 530 based on the temperature information. Accordingly, the power distributor 530 controls driving of a temperature controller 320 in the internal fixed unit 300 by controlling power transmission so as to maintain internal temperature of the radome 100 within a predetermined range.

The internal fixed unit 300 includes the azimuth tracking motor 310 and the temperature controller 320, and performs an interface function to transmit radio signals, control signals, and electrical power between the rotation unit 200 and the external fixed unit 500.

The azimuth tracking motor 310 controls the azimuth of the rotation unit 200 based on the control signal of the antenna controller 250.

The temperature controller 320 includes a heater, an active cooler/cooling fin, an air circulation fan, a convection fin, and a convection fan, and maintains the internal temperature of the radome 100 within a predetermined range.

For infinite bi-directional azimuthal rotation of the rotation unit 200, the radome 100 further includes the connection unit 400 between the rotation unit 200 and the internal fixed unit 300. The connection unit 400 includes a rotary joint part 410 and a slip ring part 420.

The rotary joint part 410 transmits a radio signal between the rotation unit 200 and the external fixed unit 500, and the slip ring part 420 transmits control and power signals between the rotation unit 200 and the internal fixed unit 300 and/or the rotation unit 200 and the external fixed unit 500.

The external fixed unit 500 that is placed outside the radome 100 includes a fixed unit triplexer 510, frequency converters 520, the power distributor 530, and a data collector 540.

The frequency converter 520 includes a Ka-band down-converter, a Ku-band down-converter, and a Ku-band up-converter, and it receives a radio signal that is received by the beam transmitting/receiving part 210 through the rotary joint part 410 and the fixed unit triplexer 510, down-converts the received radio signal, and transmits the down-converted radio signal to a main system 20. In addition, the frequency converter 520 up-converts a radio signal transmitted from the main system 20 and transmits the up-converted radio signal to the beam transmitting/receiving part 210 through the fixed unit triplexer 510 and the rotary joint part 410.

The power distributor 530 controls and distributes power of each constituent element of the antenna system 10 based on the control signal of the antenna controller 250. Particularly, the power distributor 530 controls power supplied to the heater, the active cooler, and the cooling fin in the temperature controller 320 so as to control driving of those constituent elements.

The data collector 540 gathers status information on the constituent elements of the external fixed unit 500 (i.e., the frequency converter 520, and the power distributor 530) and the rotation unit 200 and transmits the information to the main system 20 that controls the antenna system 10. And it transmits the control signal of the antenna controller 250 to the power distributor 530. For this transmission function, the data collector 540 includes a function for merging or dividing data exchanged between the respective constituent elements. In addition, the data controller 540 further includes a function for converting a received control signal from a serial to a parallel format in order to control each DC/DC converter of the power distributer 530.

For example, the control signal from the main system 20 is sent to the antenna controller 250 by the data collector 540, and the data collector 540 merges the status information of the respective constituent elements of the rotation unit 200, the internal fixed unit 300, and the external fixed unit 500 and transmits the merged information to the main system 20 and an antenna monitoring terminal (not shown). In addition, the data collector 540 converts the control signal transmitted from the antenna controller 250 from a serial into a parallel format, and transmits the parallel control signal to the power distributor 530. Therefore, the data collector 540 enables the control signal and status information transmission and power control to be performed with ease even though a part of the frequency converter 520 and the power distributor 530 are placed outside the radome 100.

As described above, a part of the frequency converter 520 and the power distributor 530, which is conventionally heavy and large in scale and placed in the rotation unit, are placed in the external fixed unit 500, thereby reducing the rotation unit 200 in weight and volume. Therefore, capacity of the azimuth tracking motor 310 used for azimuth control can be reduced, thereby saving power consumed by the antenna system 10 and reducing cost and heat dissipation from the azimuth motor driver.

In addition, the rotation unit 200 of the antenna system 10 is reduced in weight and volume so that it can be operated more promptly, thereby improving satellite tracking performance, and internal heat generation of the radome 100 is significantly reduced by placing the frequency converter 520 and the power distributor 530 that generate a large amount of heat outside the radome 100, thereby reducing power consumed for controlling internal temperature of the radome 100.

Figure 2:
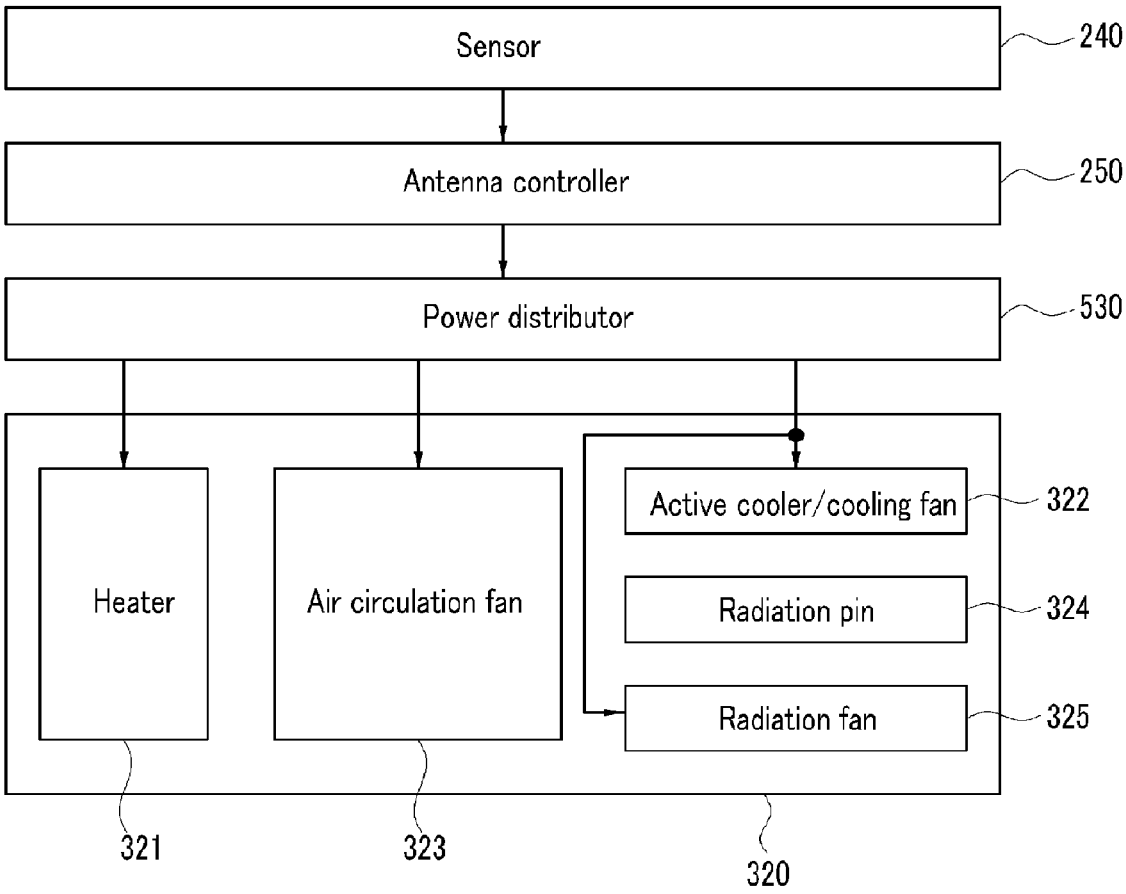
FIG. 2 is a configuration diagram of a temperature controller according to the exemplary embodiment of the present invention.

FIG. 2 shows a control diagram of the temperature controller 320 according to the exemplary embodiment of the present invention.

As shown in FIG. 2, the temperature controller 320 includes a heater 321, an active cooler/cooling fin 322, and an air circulation fan 323, and further includes a convection fin 324 and a convection fan 325.

The heater 321 increases internal temperature of the radome 100 by generating heat with power supplied from the power distributor 530.

The active cooler/cooling fin 322 transfers internal heat of the radome 100 to the outside by using power supplied from the power distributor 530.

The air circulation fan 323 circulates air to increase convection efficiency or endothermic efficiency of the heater 321 or the active cooler/cooling fin 322.

The convection fin 324 emits heat collected by the active cooler/cooling fin 322 out of the radome 100.

The convection fan 325 blows the internal heat of the radome 100, which is transmitted to the convection fin 324 through the active cooler/cooling fin 322, out of the radome 100 by using power supplied from the power distributor 530.

In other words, when receiving temperature information through the sensor 204, the antenna controller 250 operates the heater 321 by controlling the power distributor 530 to supply power to the heater 321 so as to supply heat into the radome 100 in the case that internal temperature of the radome 100 is lower than a predetermined temperature range.

However, when the internal temperature of the radome 100 is higher than the predetermined range, the antenna controller 250 operates the active cooler/cooling fin 322 by controlling the power distributor 530 so as to emit the heat out of the radome 100. In this instance, the internal heat of the radome 100, collected by the active cooler/cooling fin 322, is transmitted to the convection fin 324, and the antenna controller 250 operates the convection fan 325 by controlling the power distributor 530 so as to blow out the internal heat of the radome 100 that is transmitted to the convection fin 324.

In order to increase convection efficiency or endothermic efficiency of the heater 321 or the active cooler/cooling fin 322, the antenna controller 250 operates the air circulation fan 323 for air circulation by controlling the power distributor 530.

To increase temperature control efficiency, the heater 321, the active cooler/cooling fin 322, and the air circulation fan 323 are placed at an internal bottom plane of the internal fixed unit 300, and the convection fin 324 is placed in the external bottom plane of the internal fixed unit 300 corresponding to the active cooler/cooling fin 322. The convection fan 325 is placed in front of the convection fin 324.

As described above, the internal temperature of the radome 100 can be maintained within a predetermined range by placing the temperature controller 320 in the radome 100 of the antenna system 10, and accordingly, a life span of each of the internal modules and elements of the radome 100 can be assured.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. An antenna system, the antenna system comprising:

a rotation unit inside a radome, wherein the rotation unit is configured to at least one of receive or transmit a radio signal for satellite communication, and to track a satellite direction;

an external fixed unit outside the radome, wherein the external fixed unit comprises a frequency converter configured to frequency-convert the radio signal, and a power distributor configured to distribute power to at least a portion of the antenna system; and an internal fixed unit inside the radome, wherein the internal fixed unit comprises a temperature controller, the temperature controller configured to control temperature inside the radome to be within a predetermined range.

2. The antenna system of claim 1, wherein the internal fixed unit further comprises an azimuth tracking motor configured to track an azimuth of the rotation unit, and to provide an interface between the rotation unit and the external fixed unit.

3. The antenna system of claim 2, comprising:

a communication part between the rotation unit and the internal fixed unit, configured to transmit the radio signal for satellite communication between the rotation unit and the external fixed unit; and a control part between the rotation unit and the internal fixed unit, configured to transmit a control signal and the power between the internal fixed unit and the external fixed unit.

4. The antenna system of claim 3, wherein the rotation unit comprises:

a beam transmitting/receiving module configured to at least one of transmit or receive the radio signal for satellite communication;

at least one motor configured to control an elevation angle and a polarization angle of the rotation unit;

a sensor configured to estimate attitude information of the antenna system; and an antenna controller configured to control the at least one motor and the azimuth tracking motor based at least partly on a satellite tracking signal received through the beam transmitting/receiving module and the attitude information.

5. An antenna system, the antenna system comprising:

a rotation unit inside a radome, wherein the rotation unit is configured to at least one of receive or transmit a radio signal for satellite communication, and to track a satellite direction;

an external fixed unit outside the radome, wherein the external fixed unit comprises a frequency converter configured to frequency-convert the radio signal, and a power distributor configured to distribute power to at least a portion of the antenna system;

an internal fixed unit inside the radome, comprising an azimuth tracking motor configured to track an azimuth of the rotation unit, and to provide an interface between the rotation unit and the external fixed unit;

a communication part between the rotation unit and the internal fixed unit, configured to transmit the radio signal for satellite communication between the rotation unit and the external fixed unit;

a control part between the rotation unit and the internal fixed unit, configured to transmit a control signal and the power between the internal fixed unit and the external fixed unit;

wherein the rotation unit comprises a beam transmitting/receiving module configured to at least one of transmit or receive the radio signal for satellite communication, at least one motor configured to control an elevation angle and a polarization angle of the rotation unit, a sensor configured to estimate attitude information of the antenna system, and an antenna controller configured to control the at least one motor and the azimuth tracking motor based at least partly on a satellite tracking signal received through the beam transmitting/receiving module and the attitude information;

wherein the internal fixed unit further comprises a temperature controller configured to control an internal temperature of the radome, and wherein the sensor is configured to measure the internal temperature of the radome and to control power supplied to the temperature controller at least partly by controlling the power distributor based on the temperature information.

6. The antenna system of claim 5, wherein the temperature controller comprises a heater and an active cooler/cooling fin in an internal bottom plane of the antenna system, and the antenna controller is configured to control the power distributor to supply power to the heater based at least partly on the temperature information indicating that the internal temperature of the radome is lower than a predetermined level, and control the power distributor to supply power to the active cooler/cooling fin based at least partly on the temperature information indicating that the internal temperature of the radome is higher than the predetermined level.

7. The antenna system of claim 6, wherein the temperature controller further comprises:

an air circulation fan at an inner plane of the internal bottom plane of the antenna system, and configured to circulate internal air of the radome;

a convection fin at an external bottom plane of the antenna system corresponding to a location of the active cooler/cooling fin, and configured to emit heat that is collected through the active cooler/cooling fin out of the radome; and a convection fan in front of the convection fin, and configured to transmit internal heat of the radome outside of the radome.

8. An antenna system, the antenna system comprising:

a rotation unit inside a radome, wherein the rotation unit is configured to at least one of receive or transmit a radio signal for satellite communication, and to track a satellite direction;

an external fixed unit outside the radome, wherein the external fixed unit comprises a frequency converter configured to frequency-convert the radio signal, and a power distributor configured to distribute power to at least a portion of the antenna system; and a data collector configured to transmit status information of the rotation unit and the external fixed unit to a control system that controls the antenna system, and to transmit control signals from the control system to an antenna controller of the rotation unit.

9. The antenna system of claim 8, wherein the data collector is further configured to at least one of merge or divide data exchanged between constituent elements of the antenna system.

10. The antenna system of claim 8, wherein the data collector is further configured to convert a control signal transmitted by the antenna controller from a serial format into a parallel format.

* * * * *